US008233656B2

(12) United States Patent
Knight et al.

(10) Patent No.: US 8,233,656 B2
(45) Date of Patent: Jul. 31, 2012

(54) HEADSET

(75) Inventors: Derren Knight, Eastleigh (GB); Hutch Hutchison, Churt (GB)

(73) Assignee: Nokia Corporation (FI)

( * ) Notice: Subject to any disclaimer, the term of this patent is extended or adjusted under 35 U.S.C. 154(b) by 711 days.

(21) Appl. No.: 12/339,526

(22) Filed: Dec. 19, 2008

(65) Prior Publication Data

US 2010/0158302 A1 Jun. 24, 2010

(51) Int. Cl.
*H04R 25/00* (2006.01)

(52) U.S. Cl. ..... 381/380; 381/381; 381/370; 381/374

(58) Field of Classification Search ..... 380/381; 381/380–381, 370, 374
See application file for complete search history.

(56) References Cited

U.S. PATENT DOCUMENTS

| | | | | |
|---|---|---|---|---|
| 6,313,416 | B1 * | 11/2001 | Abroy et al. | 200/15 |
| 7,570,429 | B2 * | 8/2009 | Maliah et al. | 359/630 |
| 2007/0003098 | A1 * | 1/2007 | Martenson et al. | 381/388 |
| 2007/0053543 | A1 * | 3/2007 | Lee | 381/381 |
| 2007/0133836 | A1 * | 6/2007 | Lee | 381/370 |
| 2007/0183055 | A1 * | 8/2007 | Maliah et al. | 359/632 |
| 2008/0013714 | A1 * | 1/2008 | Sung et al. | 379/430 |
| 2008/0051166 | A1 * | 2/2008 | Kang et al. | 455/575.7 |
| 2008/0144877 | A1 * | 6/2008 | Ham et al. | 381/379 |
| 2008/0260196 | A1 * | 10/2008 | Tsai | 381/380 |
| 2008/0310656 | A1 * | 12/2008 | Tsai | 381/151 |

FOREIGN PATENT DOCUMENTS

| | | | |
|---|---|---|---|
| EP | 1 761 001 | A2 | 3/2007 |
| EP | 1 791 335 | A2 | 5/2007 |
| WO | 2008/145127 | A1 | 12/2008 |

OTHER PUBLICATIONS

Feb. 23, 2010, International Search Report dated Feb. 23, 2010 from Patent Cooperation Treaty Application No. PCT/EP2009/008311, pp. 1-4.

* cited by examiner

*Primary Examiner* — A. Sefer
(74) *Attorney, Agent, or Firm* — Alston & Bird LLP

(57) ABSTRACT

A headset with an elongated housing is provided with an in ear speaker that is suspended from the elongated housing so that it may assume a stowed position in which the in ear speaker is substantially in line with the elongated housing and may assume a deployed position in which the in ear speaker is disposed sidewards from said elongated housing. The in ear speaker may be suspended from the elongated housing by an arm, such as a simple arm or a parallel arm mechanism.

20 Claims, 4 Drawing Sheets

HEADSET

FIELD

The invention relates generally to apparatuses comprising a microphone for detecting sound, such as speech, for forwarding signals based on the detected sound to an external device. In particular, the invention relates to headsets for use in wired or wireless communication applications, and even more particularly to a headset with an in ear speaker.

BACKGROUND

Headsets are used in a variety of applications, such as telephone communications, artistic performances, dictation and so on. Such devices permit a user to speak into an input means, such as a microphone, and/or listen to audio output of a speaker without having to hold the device in their hand. Furthermore, the use of a headset may allow a user to perform such applications without necessarily remaining stationary.

Recently, wireless headsets have become available. Such devices may use wireless communication protocols, such as Bluetooth, in order to transmit data to, and receive data from, an external device.

In many examples of the prior art, the headset comprises a body with attachment means allowing the device to be clipped onto, or otherwise held in position over, a user's ear. Typically, such types of headsets have an in ear speaker sidewardly protruding from the main and often elongated body. The microphone is provided on the opposite end of the elongate body to position the microphone close to the user's mouth.

To enable a headset to sit comfortably in the ear and within the external auditory canal, the ear piece speaker position is critical in relation to the housing and it is this requirement that produces an offset distance between the housing and the speaker.

When not in use it is desirable to cover and protect the headset, in particular the ear piece to prevent the unit from picking up debris such as fluff and dust on a part which will then be inserted into the user's ear.

The offset distance between the speaker and main housing makes enclosing the unit within a slim line case for storage and charging difficult. This distance is typically 10 mm and may be larger than the housing width.

SUMMARY

The disclosed exemplary embodiments provide an apparatus comprising a housing and an in ear speaker that is arranged movable relative to the elongated housing. Thus, it becomes possible to provide a device with a smaller footprint that may be more easily covered and protected.

In one exemplary embodiment the in ear speaker can assume a stowed position and can assume a deployed position.

In another exemplary embodiment the in ear speaker is substantially aligned with the housing or is received inside the housing in the stowed position.

In yet another exemplary embodiment the in ear speaker is protruding from the elongated housing in the deployed position.

In one exemplary embodiment the in ear speakers suspended from the body by an arm. This allows the speaker to be retracted into the stowed position when the device is not in use and for a cover to be fitted.

In another exemplary embodiment the in ear speaker is suspended movably from the elongated housing so as to allow the in ear speaker to assume a stowed position in which the in ear speaker is disposed substantially in line with the elongated housing and to assume a deployed position in which the in ear speaker is disposed sidewards from the elongated housing.

The deployed position may be a stable position and the stowed position may be a stable position.

In another exemplary embodiment the in ear speaker is suspended from the elongated housing by a simple arm.

In a further exemplary embodiment the in ear speaker is suspended from the elongated housing by a parallel arm mechanism.

In another exemplary embodiment the parallel arm mechanism comprises a spring detent cam to lock the arms in the deployed and in the stowed position.

In yet another exemplary embodiment the parallel arm mechanism comprises three arms, a central arm including a cam profile which engages a resiliently biased plunger to form the detent.

In a further exemplary embodiment the central arm and plunger are hollow to allow for a speaker connection through a flex or wire.

In a further exemplary embodiment the detent block is guided on the housing frame by side rails which locate in channel on the plunger detent.

In a further exemplary embodiment the central arm is provided with a cam and one side arm to control movement of the speaker.

In another exemplary embodiment the headset is switched on in one position of the in ear speaker and switched off in another position of the in ear speaker.

The disclosed exemplary embodiments also provide for a method for allowing electrical connection to a speaker through moving joints of a spring detent parallel arm mechanism.

Further objects, features, advantages and properties of headset according to the present application will become apparent from the detailed description.

BRIEF DESCRIPTION OF THE DRAWINGS

In the following detailed portion of the present description, the teachings of the present application will be explained in more detail with reference to the example embodiments shown in the drawings, in which.

DETAILED DESCRIPTION

In the following detailed description, the device according to the teachings for this application in the form of a headset will be described by the exemplary embodiments.

FIGS. 1 to 6 illustrate an example of a wireless headset in which the teachings of the present application may be applied. The headset 1 is capable of communicating locally via a local link to one or more local devices such as a mobile terminal or a mobile phone. The local link can be any type of link with a limited range, but not limited to, such as Bluetooth, a Universal Serial Bus (USB) link, a Wireless Universal Serial Bus (WUSB) link, an IEEE 802.11 wireless local area network link, a Radio Standard link for example an RS-232 serial link, etc.

The internal components, software and protocol structure of the head set 1 will not be described as they are well known in the art.

Figure 1:
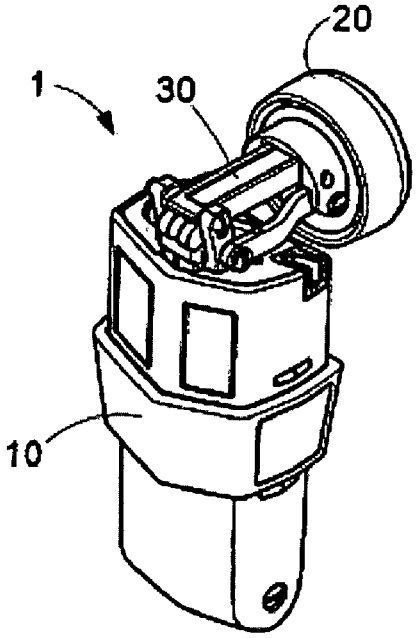
FIGS. 1 and 2 are elevated views of a headset according to an embodiment with an in ear speaker in a deployed position.
Figure 2:
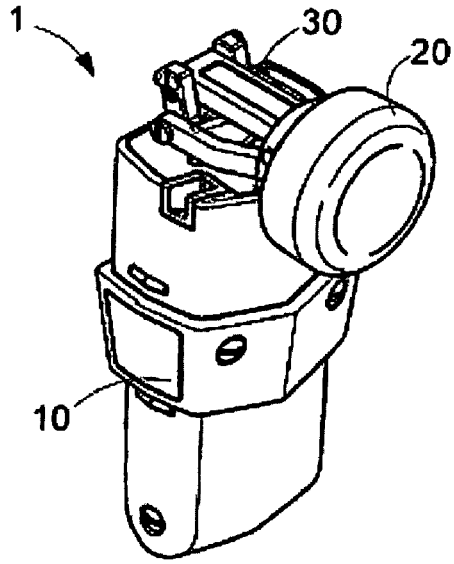
Figure 3:
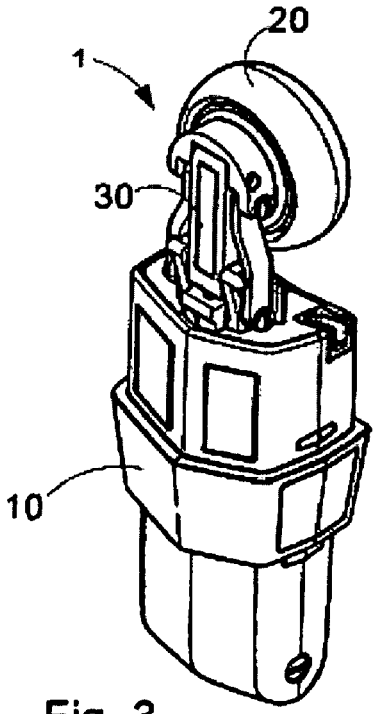
FIGS. 3 and 4 are elevated views of the headset according to FIGS. 1 and 2 with the in ear speaker in a stowed position.
Figure 4:
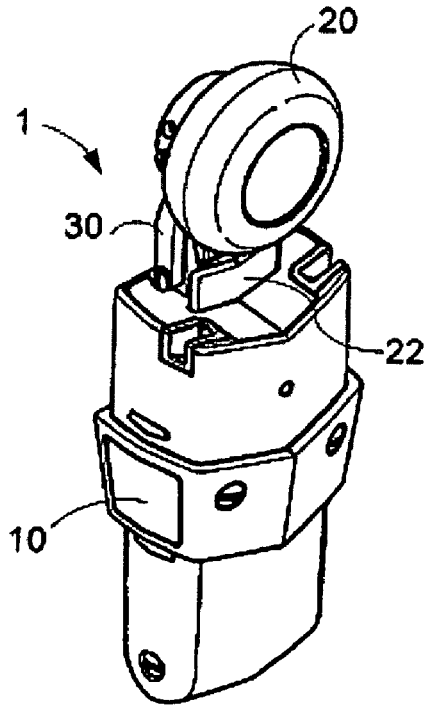
Figure 5:
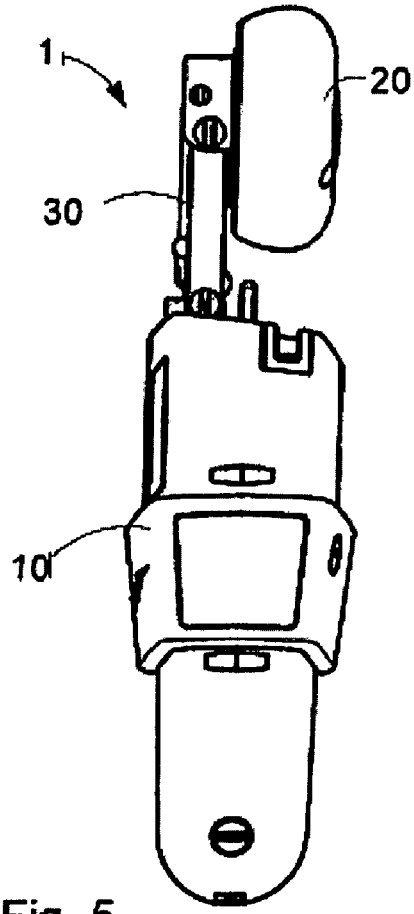
FIG. 5 is a plane side view of a device according to FIGS. 1 to 4 with the in ear speaker in the stowed position.
Figure 6:
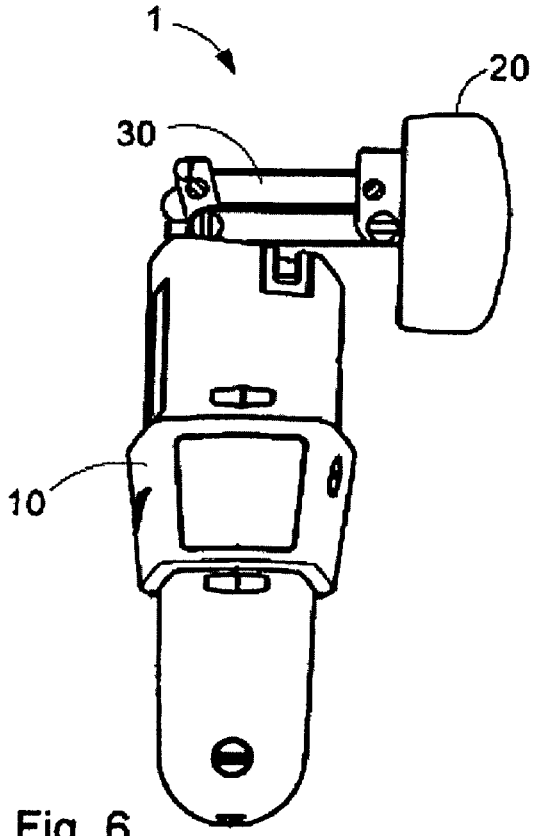
FIG. 6 is a plane side view of a device according FIG. 5 with the in ear speaker in the deployed position.
Figure 7:
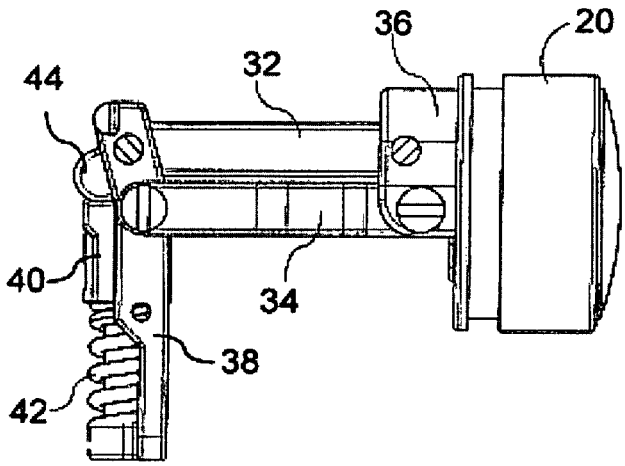
FIG. 7 is a detailed side view of an embodiment of a folding arm mechanism for a headset with the arm and the speaker thereon in the deployed position.
Figure 8:
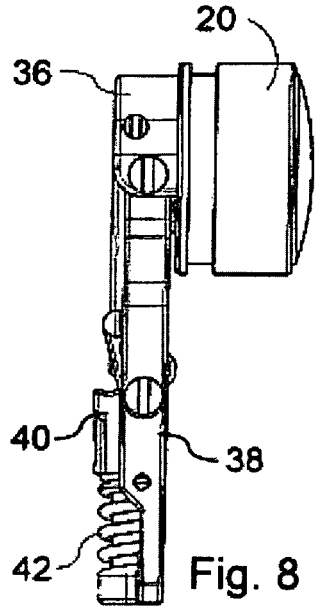
FIG. 8 is a detailed side view of the folding arm mechanism of FIG. 7 in the stowed position.
Figure 9:
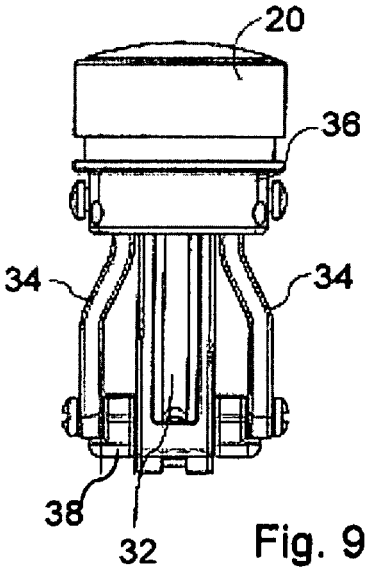
FIG. 9 is a detailed top view of the folding arm mechanism of FIG. 7 in the deployed position.
Figure 10:
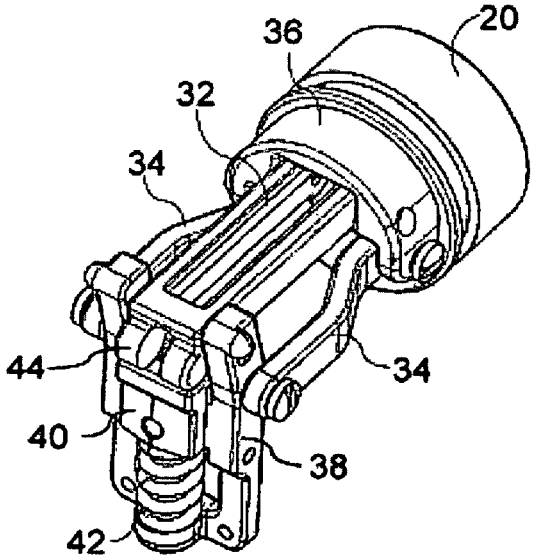
FIG. 10 is a detailed elevated view of the folding arm mechanism of FIG. 7 in the deployed position.
Figure 11:
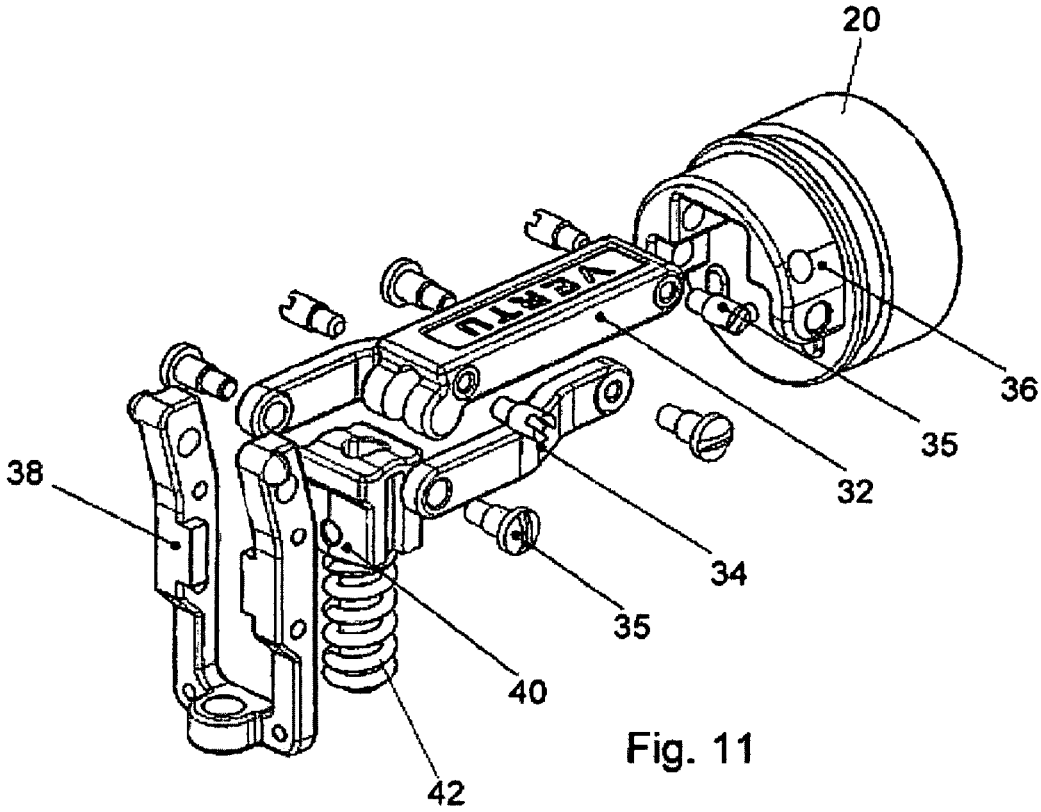
FIG. 11 is a detailed elevated exploded view of the folding arm mechanism of FIG. 7 in a deployed position.
Figure 12:
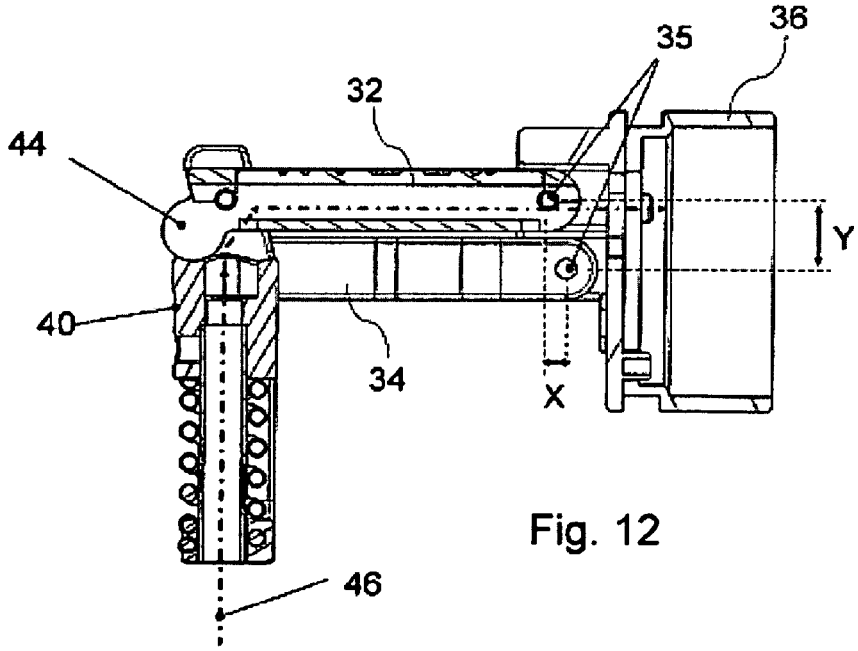
FIG. 12 is a detailed sectional view of the folding arm mechanism of FIG. 7 in a deployed position.

The headset 1 includes a housing 10 and in ear speaker 20. The housing 10 includes the electronic components of the headset and is provided with a microphone at the end of the elongated housing 10 opposites to the end at which the speaker 20 is disposed. The in ear speaker 20 is suspended from the housing 10 to allow the in ear speaker 20 to assume a deployed position shown in FIGS. 1,2 and 6, which the in ear speaker 20 protrudes from the elongated housing 10 and a stowed position shown in FIGS. 3, 4 and 7, in which the in ear speaker 20 is substantially aligned with the elongated housing 10. Alternatively, the in ear speaker 20 can be received inside the housing 10 in the stowed position. The orientation of the speaker 20 is important in the deployed position since the housing 10 should be at a 90° angle with the speaker 20 at this position in the ear so that housing 10 extends substantially alongside the head of the user. However, the orientation of the speaker in the stowed position is less important and therefore a simple arm could be used to suspend the speaker 20 from the housing 10.

In the present embodiment the speaker 20 is suspended from the housing 10 by a parallel arm mechanism 30. The parallel arm mechanism includes a spring detent cam that will be described in further detail below to lock the parallel arm mechanism 30 in a deployed and stowed position. The user simply pushes on the speaker 20 to overcome the detent lock, the spring and cam action then powers the movement between the deployed position and the stowed away position. The speaker travels in a parallel manner i.e. 90 degrees to the housing throughout the movement range.

In the present embodiment the headset 1 is automatically switched on when the speaker 20 is moved to the deployed position and automatically switched off when the speaker 20 is moved to the stowed away position. When the parallel arm mechanism 30 is moved to the deployed position it presses a protruding activation member 22 (FIG. 4) down and thereby activates a power switch that powers on the headset 1. The switch is resiliently biased and the activation member 22 reassumes its protruding position when the parallel arm mechanism 30 is moved to the stowed away position.

FIGS. 7 to 12 illustrate the parallel arm mechanism 30 in greater detail. The design includes center arm 32 and outer arms 34, a series of pivot positions and stops. A speaker housing 36 connects the speaker 20 to the distal extremity of the three arms 32, 34 via pivot pins 35.

The central arm 32 includes a cam 44 which engages a cam profile on the top of a resiliently biased plunger 40 to form the detent. The central arm 32 and plunger 40 are hollow to allow for a speaker connection through a flex or wire 46. The cam 44 is split to allow passage of the flex or wire 46. A helical wire spring 42 urges the plunger 40 towards the cam 44.

A bracket 38 connects via pivots 35 to the proximate ends of the three arms 32, 34 and the bracket 38 is provided with side rails that are received in channels in the plunger 40 to guide the reciprocating movement of the plunger 40. The bracket 38 also forms a support for the helical wire spring 42. The bracket 38 is secured to the housing 10, The parallel arm mechanism 30 has been developed to give a slim line profile whilst in the stowed position. When deployed the arms 32, 34 separate to form a strong robust structure.

To produce a smooth movement and to prevent the parallel arm mechanism 30 from locking up when activated by the user, the vertical offset Y and the horizontal offset distance X between pivot locations 35 on the arms 32, 34 is crucial.

The parallel arm mechanism 30 is held together by a series of pivots 35, these include a screw thread surface to retain the arm, a shoulder/step surface to locate and a bearing surface for free movement.

The parallel arm mechanism 30 may be made from, and is not limited to stainless steel, other metals or alloys, plastic or composite materials.

The design is extremely small and has been developed to be highly visible, similar in design appeal to mechanism featured on high end luxury watches.

The various aspects of what is described above may be used alone or in various combinations.

The teaching of the present application has numerous advantages. Different embodiments or implementations may yield one or more of the following advantages. It should be noted that this is not an exhaustive list and there may be other advantages which are not described herein. For example, one advantage of the teaching of this application is that it reduces the overall size foot print of the headset when not in use. Another exemplary advantage of the teaching of the present application is that it allows for a slim cover to be fitted to protect the device. It is another advantage of the headset that it provides for a spring detent in the locked and in the stowed position. It is another advantage of the teaching of the present application that it provides for a method to allow electrical connection to speaker through moving joints.

Although the teaching of the present application has been described in detail for purpose of illustration, it is understood that such detail is solely for that purpose, and variations may be made therein by those skilled in the art without departing from the scope of the teaching of this application.

For example, although the teaching of the present application has been described in terms of a mobile phone, it should be appreciated that the teachings of the present application may also be applied to other types of electronic devices, such as music players, palmtop computers and the like. It should also be noted that there are many alternative ways of implementing the methods and apparatuses of the teachings of the present application.

Features described in the preceding description may be used in combinations other than the combinations explicitly described.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The term "comprising" as used in the claims does not exclude other elements or steps. The term "a" or "an" as used in the claims does not exclude a plurality. A unit or other means may fulfill the functions of several units or means recited in the claims.

The invention claimed is:

1. An apparatus comprising: an elongated housing; an in ear speaker configured to move relative to the elongated housing; and a parallel arm mechanism comprising a plurality of parallel arms, each parallel arm having a proximate end that is connected via a proximate pivot to the elongated housing and a distal end that is connected via a distal pivot to the in ear speaker, wherein the proximate pivots of the parallel arms, the distal pivots of the parallel arms and the parallel arms are configured to maintain the in ear speaker in a parallel orientation relative to the elongated housing as the parallel arms are rotated about the proximate pivots between a stowed position, in which the parallel arms are substantially aligned with the elongated housing, and a deployed position, in which the distal ends of the parallel arms protrude sideward from the elongated housing.

2. An apparatus according to claim 1, wherein said in ear speaker is configured to move between a stowed position and a deployed position.

3. An apparatus according to claim 2, wherein the in ear speaker is substantially aligned with said housing or is received inside said housing in the stowed position.

4. An apparatus according to claim 2, wherein the in ear speaker protrudes from said elongated housing in the deployed position.

5. An apparatus according to claim 1, wherein said deployed position is a stable position.

6. An apparatus according to claim 1, wherein said stowed position is a stable position.

7. An apparatus according to claim 1, wherein said parallel arm mechanism comprises a spring detent cam to lock the arms of the parallel arm mechanism in the deployed position and in the stowed position.

8. An apparatus according to claim 7, wherein said parallel arm mechanism comprises three arms, with a central arm including a cam profile which engages a resiliently biased plunger to form the detent.

9. An apparatus according to claim 8, wherein the central arm and plunger are hollow to allow for a speaker connection through a flex or wire.

10. An apparatus according to claim 8, wherein the central arm with a cam and a side arm together control movement of the in ear speaker.

11. An apparatus according to claim 7, wherein the parallel arm mechanism is made from stainless steel.

12. An apparatus according to claim 7, wherein a detent plunger is guided on the housing frame by side rails which are received in channels on the detent plunger.

13. An apparatus according to claim 1, wherein said apparatus is a headset, especially a wireless headset.

14. An apparatus according to claim 1, wherein a microphone is arranged in said elongated housing near the end of the elongated housing opposite to the end of the elongate housing where the speaker is suspended from the housing.

15. An apparatus according to claim 1, wherein said apparatus is configured to switch on in one position of the in ear speaker and said apparatus is configured to switch off in another position of the in ear speaker.

16. An apparatus according to claim 1, wherein the elongated housing is elongate in a lengthwise direction and the proximate pivots are offset in the lengthwise direction and the distal pivots are offset in the lengthwise direction.

17. An apparatus according to claim 16, wherein the proximate pivots are offset in the widthwise direction and the distal pivots are offset in the widthwise direction, wherein the widthwise direction is perpendicular to the lengthwise direction.

18. An apparatus according to claim 1, wherein said parallel arm mechanism comprises a lock to lock the arms of the parallel arm mechanism in the deployed position and in the stowed position.

19. An apparatus according to claim 1, wherein said parallel arm mechanism comprises a resilient bias that biases the parallel arm mechanism preferentially towards the stowed position and towards the deployed position.

20. A method comprising: providing an elongated housing, an in ear speaker configured to move relative to the elongated housing, and a parallel arm mechanism comprising a plurality of parallel arms, each parallel arm having a proximate end that is connected via a proximate pivot to the elongated housing and a distal end that is connected via a distal pivot to the in ear speaker, wherein the proximate pivots of the parallel arms, the distal pivots of the parallel arms, and the parallel arms are configured to maintain the in ear speaker in a parallel orientation relative to the elongated housing as the parallel arms are rotated about the proximate pivots between a stowed position, in which the parallel arms are substantially aligned with the elongated housing, and a deployed position, in which the distal ends of the parallel arms protrude sideward from the elongated housing.

* * * * *